US005755011A

United States Patent [19]

Green et al.

[11] Patent Number: 5,755,011

[45] Date of Patent: May 26, 1998

[54] ADJUSTABLE HINGE

[75] Inventors: Richard L. Green; Scott J. Rote; Michael D. Smith; William T. DeBruyn; Thomas M. Wright, all of Rockford, Ill.

[73] Assignee: Newell Operating Company, Freeport, Ill.

[21] Appl. No.: 579,774

[22] Filed: Dec. 28, 1995

[51] Int. Cl.[6] ..... E05D 7/04

[52] U.S. Cl. ..... 16/238; 16/239; 16/241; 16/243; 16/245

[58] Field of Search ..... 16/237, 238, 239, 16/240, 241, 243, 244, 245, 246, 235, 236

[56] References Cited

U.S. PATENT DOCUMENTS

| | | | |
|---|---|---|---|
| 442,547 | 12/1890 | Radler | 16/243 |
| 1,103,607 | 7/1914 | Moore | 16/244 |
| 2,373,955 | 4/1945 | Fuller | 16/238 |
| 2,588,258 | 3/1952 | Lowman | 16/243 |
| 5,144,721 | 9/1992 | Schade | 16/237 |
| 5,339,493 | 8/1994 | MacIntyre | 16/238 |

FOREIGN PATENT DOCUMENTS

| | | | |
|---|---|---|---|
| 2455805 | 6/1975 | Germany | 16/238 |
| 3-39581 | 2/1991 | Japan | 16/243 |
| 3-187486 | 8/1991 | Japan | 16/237 |
| 4-70480 | 3/1992 | Japan | 16/235 |

*Primary Examiner*—Daniel W. Howell
*Assistant Examiner*—Donald M. Gurley
*Attorney, Agent, or Firm*—Foley & Lardner

[57] ABSTRACT

An adjustable hinge including a first hinge member having a hinge sleeve and a second hinge member having a guide, with a door leaf coupled to the second hinge member and having at least one tab received within the guide for guiding movement therealong, the door leaf also coupled to the first hinge member and received within the hinge sleeve, allowing selective pivotal movement of the first hinge member relative to the second hinge member about a rotational axis extending in a vertical direction. The adjustable hinge features a vertical adjustment mechanism received within the hinge sleeve allowing selective movement of the first hinge member relative to the second hinge member in the vertical direction, and a horizontal adjustment mechanism within a cavity formed within the second hinge member with at least one tab of the door leaf is guidably moved along the guide, allowing selective movement of the first hinge member relative to the second hinge member in a horizontal direction.

16 Claims, 5 Drawing Sheets

FIG. 3
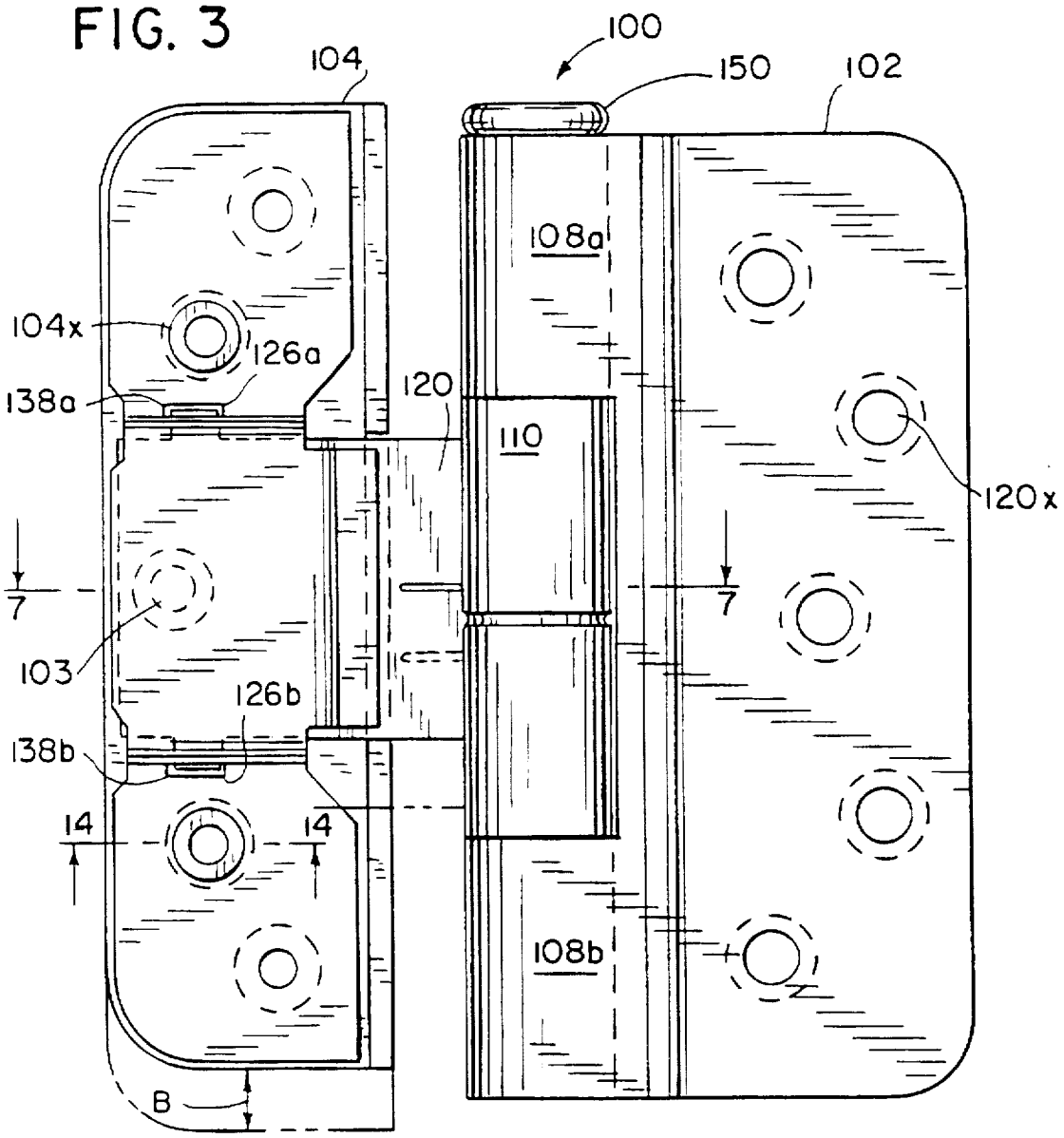
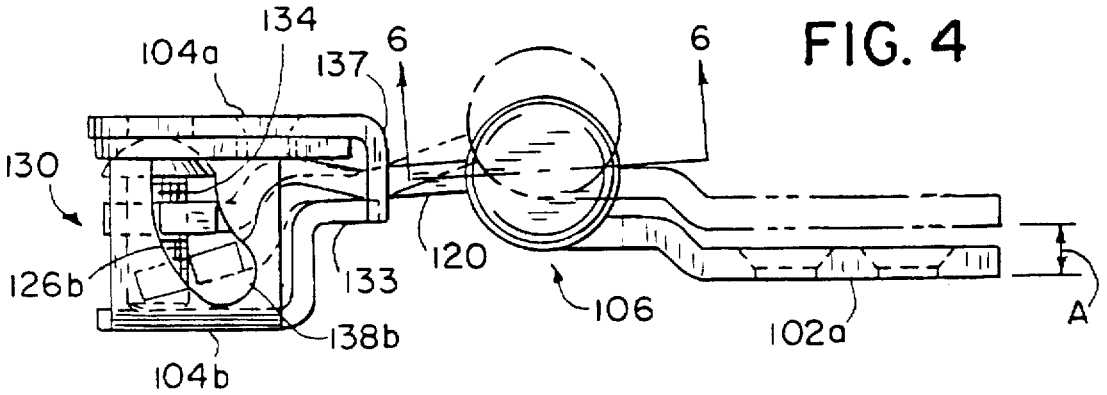
FIG. 4

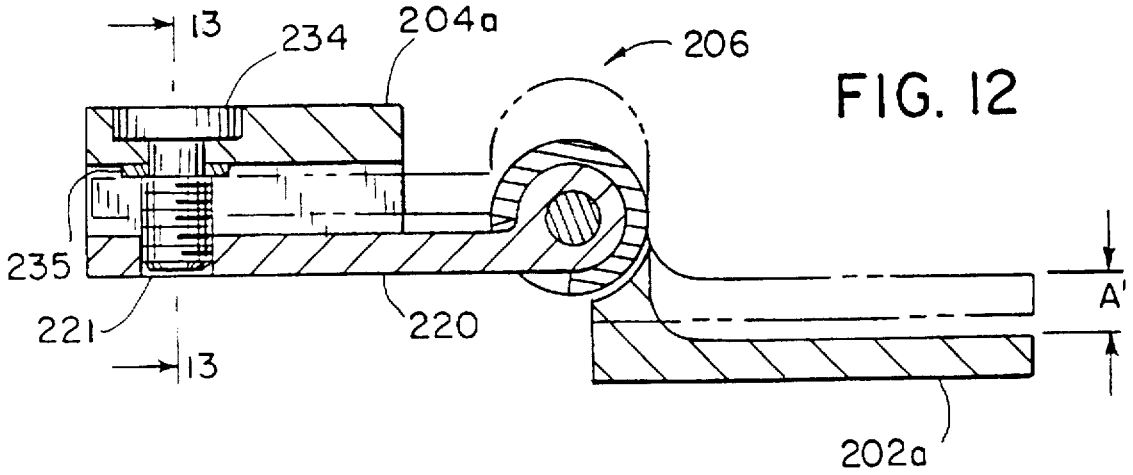
FIG. 12
FIG. 13
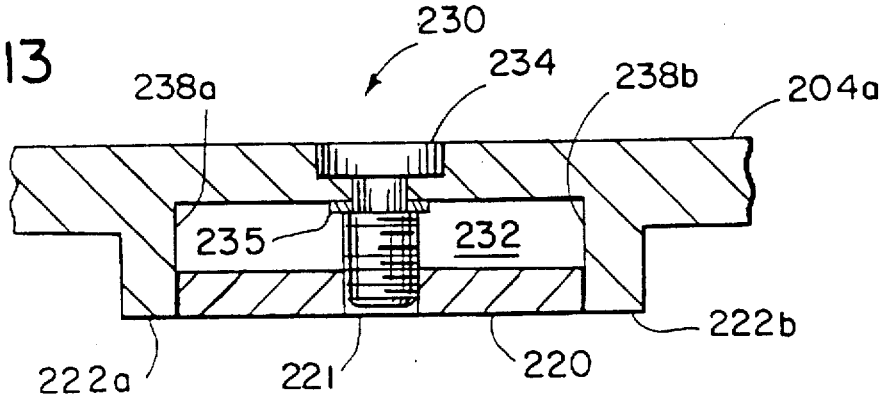
FIG. 14
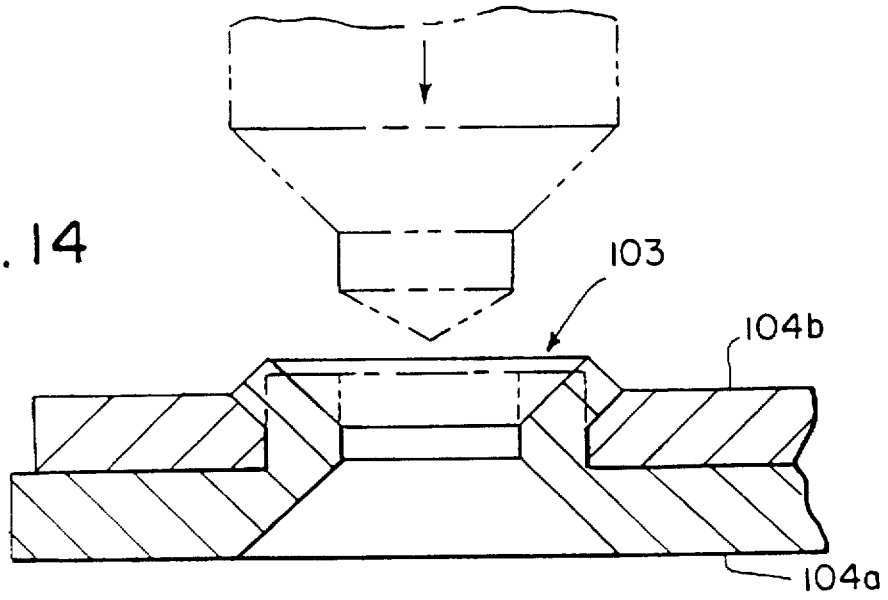

ADJUSTABLE HINGE

FIELD OF THE INVENTION

The present invention relates to a hinge for a door or the like, which provides for independent adjustment of the vertical position and the horizontal position of the door relative to a mounting frame. The present invention also relates to a two-way adjustable hinge of a relatively simple construction which features a horizontal adjustment mechanism incorporated within a first hinge member received in the door and a vertical adjustment mechanism incorporated within a hinge assembly coupling the first hinge member to a second hinge member mounted to the mounting frame.

BACKGROUND OF THE INVENTION

Adjustable hinges for mounting a door or the like on a mounting frame are generally known in the art. Some known adjustable hinges allow one-way adjustment of the position of the door relative to the mounting frame in a vertical direction. (By "vertical" adjustment as used herein is meant adjustment in a substantially vertical direction typically aligned with the axis of pivotal rotation of the door.) Other known adjustable hinges allow one-way adjustment of the door in a horizontal direction, such as is disclosed in U.S. Pat. No. 4,825,507, issued to Killingstad on May 2, 1989 (employing two adjusting screws to adjust the position of one hinge member with respect to another and a securing screw to retain the position). (By "horizontal" adjustment as used herein is meant adjustment in a substantially horizontal direction, typically perpendicular to the axis of pivotal rotation of the door, that may also be called "transverse", "lateral" or other like terms by those of ordinary skill in the art.)

Still other adjustable hinges, such as disclosed in U.S. Pat. No. 5,339,493, issued to MacIntyre on Aug. 23, 1994, and British Patent Application No. 2032994, published on May 14, 1980, allow two-way adjustment of the position of the door relative to the mounting frame in both the vertical direction and the horizontal direction. As disclosed in U.S. Pat. No. 5,339,493 and British Patent Application No. 2032994, such two-way adjustable hinges allow the positioning of the door within the frame after the door has been mounted in the frame.

However, the adjustable hinge disclosed in U.S. Pat. No. 5,339,493 is of a relatively complex arrangement, incorporating both vertical and horizontal adjustment means within a base member received in a cover mounted within the door. Horizontal adjustment of the door relative to the mounting frame is effected by adjusting the position of a coupling door leaf with an adjustment screw received within a notch in the door leaf (between a head and a shoulder of the adjustment screw), which is in turn received within a threaded passage in the base member; the position of the door leaf relative to the base member is adjusted pivotally (leveraged) on a rib projecting inwardly from the cover. Vertical adjustment is effected by turning an adjustment screw with an inner beveled end portion which is received within the cover and engages (in supporting contact at a bearing area) an upper flat surface of the base member (to which the door leaf is fixed) thereby controlling its relative vertical position. When vertical adjustment is effected, the entire horizontal adjustment means itself is also moved vertically (i.e. the base member is moved within the cover). This arrangement provides a relatively limited range of leveraged horizontal adjustment, given the limited depth within which the cover typically would be mounted within the door. Moreover, this arrangement, due to its relative complexity, is not particularly well-suited for production by lower-cost manufacturing methods, such as stamping, nor to construction using premium materials such as brass.

The adjustable hinge disclosed in British Patent Application No. 2032994 is also of a relatively complex arrangement, with both the vertical and horizontal adjustment means contained within a single slide (base) member movably received in a housing mounted within the door. Horizontal adjustment of the slide member relative to the housing (and thus the door relative to the mounting frame) is accomplished by turning an adjusting spindle, which rotatably passes through a screw-threaded bore in the slide member but is fixed within the inward wall of the housing, so that the slide member slides horizontally within the housing. Vertical adjustment is accomplished by adjusting a fixing screw retaining a hinge member coupled to the mounting frame against the slide member through a vertically elongated slot, along which the vertical position of the hinge member with respect to the slide member can be moved. This relatively complex arrangement does not lend itself to lower-cost manufacturing methods or to the use of premium materials.

Another two-way adjustable hinge (incorporating the horizontal adjustment arrangement of U.S. Pat. No. 4,825,507) manufactured by the assignee of the present application is disclosed in a sales catalog of Andersen Corp. titled "A Complete Guide to Anderson Windows and Patio Doors" at page 132, item 7 (catalog 65M 12-93 No. 941, revised Nov. 12, 1993). The Andersen device employs a horizontal adjustment means within the pivoting mechanism of the two hinge members. However, the Andersen device employs a ball bearing arrangement (not visible in the catalog) which supports the vertical load; the first hinge member is welded to the hinge pin and adjusted in its bearing position on the ball bearing by a vertical adjustment screw.

Accordingly, it would be advantageous to have an adjustable hinge that is suitable for lower-cost manufacturing methods. It would also be advantageous to have an aesthetically pleasing, adjustable hinge that is of a relatively simple, high-strength construction. It would further be advantageous to have a compact design for an adjustable hinge that is more easily installed in a door or mounting frame and more easily adjusted after installation. It would further be advantageous to have an adjustable hinge that allows the use of wear-resistant materials and maintenance-free operation (not requiring oiling of mating parts). It would further be advantageous to have an adjustable hinge that is designed to allow the use of a wide range of corrosion-resistant and premium materials (such as brass) or surface finishes that are compatible with existing hardware. It would further be advantageous to have an adjustable hinge that incorporates the foregoing advantages while permitting a relatively wide range of independent adjustment in both the vertical and horizontal directions.

An improved adjustable hinge incorporating the foregoing advantages would be a significant advance in the art.

SUMMARY OF THE INVENTION

The present invention relates to an adjustable hinge including a first hinge member and a second hinge member, with pivotal coupling means for coupling the first hinge member to the second hinge member and for allowing pivotal movement of the first hinge member relative to the second hinge member about a rotational axis extending in a vertical direction. The adjustable hinge also includes vertical adjustment means contained within the pivotal coupling means for selectively allowing movement of the first hinge member relative to the second hinge member in the vertical direction, and horizontal adjustment means contained within the first hinge member for selectively allowing movement of the first hinge member relative to the second hinge member in a horizontal direction.

The present invention also relates to an adjustable hinge including a first hinge member having a hinge sleeve with an upper portion and a lower portion and a second hinge member having a guide, with a door leaf having a first end and a second end, the first end being coupled to the second hinge member and having at least one tab received within the guide of the second hinge member for guiding movement therealong, and the second end coupled to the first hinge member, the second end having an upper extension and a lower extension, the upper extension received within the upper portion of the hinge sleeve and the lower extension received within the lower portion of the hinge sleeve, selectively allowing pivotal movement of the first hinge member relative to the second hinge member about a rotational axis extending in a vertical direction. The adjustable hinge also includes a vertical adjustment screw threadably received within the lower portion of the hinge sleeve below the lower extension of the door leaf for movement within the hinge sleeve, to allow selective movement of the first hinge member relative to the second hinge member in the vertical direction, and a horizontal adjustment screw threadably received within a threaded hole in the first end of the door leaf, the first end of door leaf being retained by the horizontal adjustment screw within a cavity formed within the second hinge member, so that rotation of the horizontal adjustment screw moves the tab along the guide, to allow selective movement of the first hinge member relative to the second hinge member in a horizontal direction.

The present invention further relates to an adjustable hinge including a first hinge member having a hinge sleeve with an upper portion and a lower portion, a second hinge member having a guiding recess, and a door leaf having a first end and a second end, the first end being coupled to the second hinge member and received within the guiding recess for movement therealong, and the second end pivotally coupled to the first hinge member with a pivot pin, the pivot pin having an upper extension and a lower extension, the upper extension received within the upper portion of the hinge sleeve and the lower extension received within the lower portion of the hinge sleeve, selectively allowing pivotal movement of the first hinge member relative to the second hinge member about a rotational axis extending in a vertical direction. The adjustable hinge also includes a vertical adjustment screw threadably received within the lower portion of the hinge sleeve below the lower extension of the door leaf for movement within the hinge sleeve, to allow selective movement of the first hinge member relative to the second hinge member in the vertical direction, and a horizontal adjustment screw threadably received within a threaded hole in the first end of the door leaf, the first end of door leaf being coupled by the horizontal adjustment screw to the second hinge member, so that rotation of the horizontal adjustment screw moves the first end of the door leaf along the guiding recess, to allow selective movement of the first hinge member relative to the second hinge member in a horizontal direction.

BRIEF DESCRIPTION OF THE DRAWINGS

FIG. 3 is a front view of the two-way adjustable hinge in an opened position;

FIG. 4 is a bottom view of the two-way adjustable hinge in an opened position also showing the range of horizontal adjustment;

FIG. 12 is a bottom view of an alternative embodiment of the two-way adjustable hinge in an opened position also showing the range of horizontal adjustment;

FIG. 13 is a sectional and cut-away view of the horizontal adjustment mechanism of an alternative embodiment of the two-way adjustable hinge along line 13—13 in FIG. 12; and FIG. 14 is a cutaway view of the arrangement by which the two-way adjustable hinge along line 14—14 in FIG. 3 is assembled.

In the various FIGURES, like reference numerals are used to show like components.

DETAILED DESCRIPTION OF THE PREFERRED EMBODIMENTS

Figure 1:
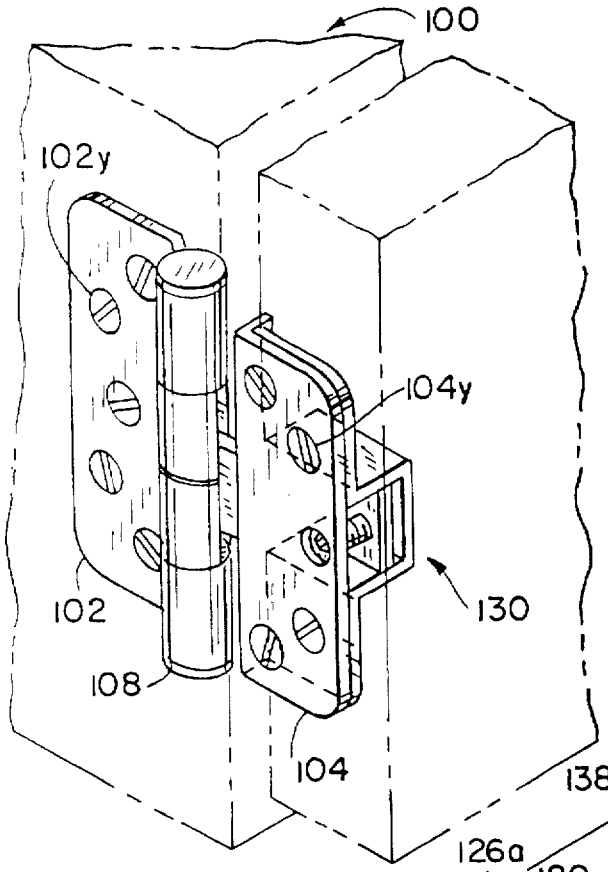
FIG. 1 is a perspective view of a two-way adjustable hinge according to a preferred embodiment of the present invention in an opened position (also showing in a phantom cut-away view a door and mounting frame)
Figure 2:
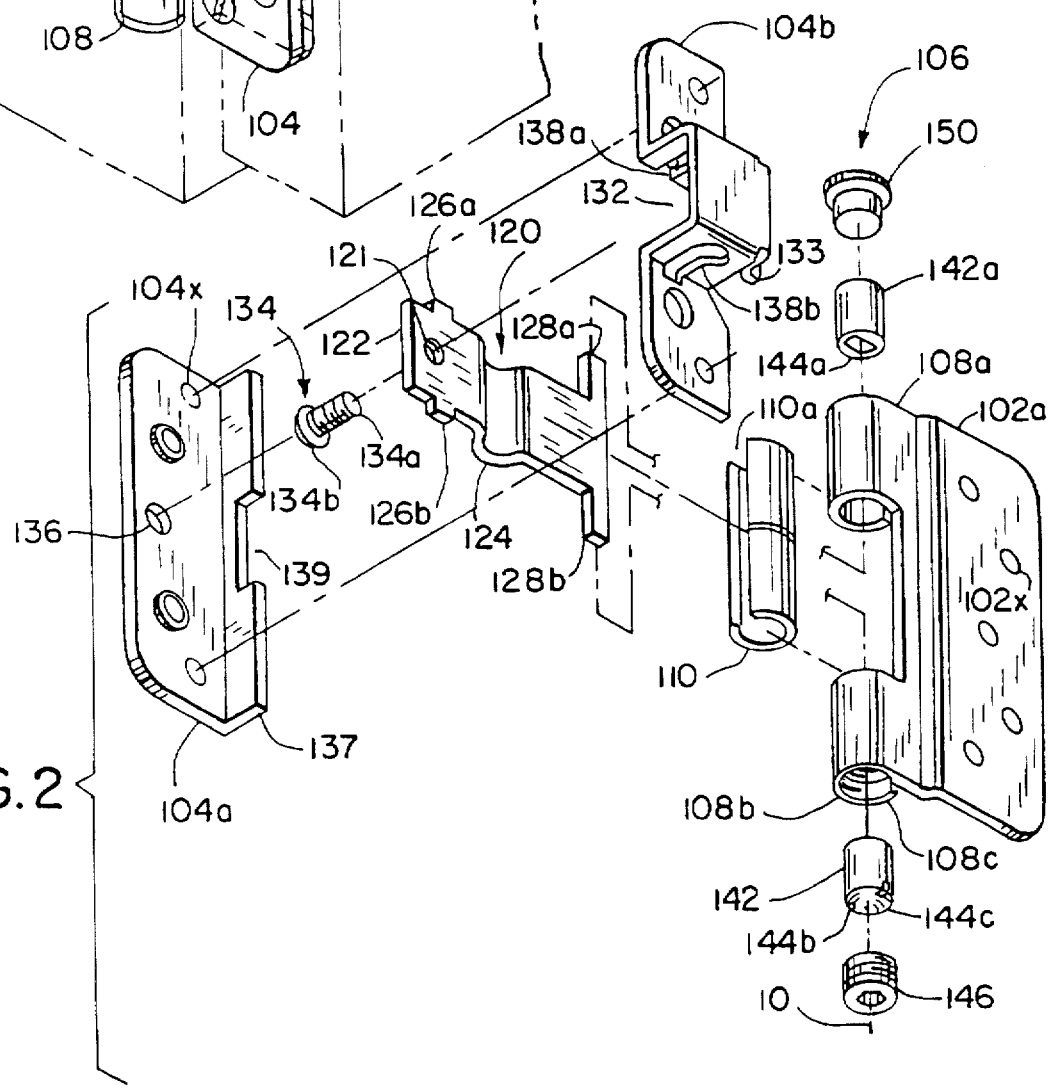
FIG. 2 is a exploded perspective view of the two-way adjustable hinge in an opened position.

Referring now to the figures, FIGS. 1 to 9 illustrate a preferred embodiment of a two-way adjustable hinge according to the present invention (shown with a door and mounting frame in phantom in FIG. 1). FIG. 2 illustrates two-way adjustable hinge 100 in an exploded perspective view, readily allowing examination of its arrangement. Adjustable hinge 100 comprises a first hinge member 102 (shown by a jamb leaf 102*a*) and a second hinge member 104 (shown by a cover plate 104*a* and a backing member 104*b*) pivotally coupled within a hinge assembly 106 by a door leaf 120. Hinge assembly 106 includes a hinge sleeve 108 comprising an upper sleeve portion 108*a* and a lower sleeve portion 108*b*(e.g. upper and lower curved knuckles integrally formed from jamb leaf 102*a*), each portion having a circular bore extending axially therethrough to define a rotational axis (shown by line 10).

Hinge assembly 106 also includes a shroud 110 having a circular bore extending axially therethrough along rotational axis 10. As shown in FIG. 2, shroud 110 fits within a space between upper sleeve portion 108*a* and lower sleeve portion 108*b* of hinge sleeve 108. A top hinge cap 150 fits into the circular bore within upper sleeve portion 108*a* of hinge sleeve 108. (In an alternative embodiment (not shown), the hinge assembly can have a bottom hinge cap.)

As shown in FIG. 2, Door leaf 120 is of an arched construction with a central arch 124. Door leaf 120 also has door leaf extensions 128*a* and 128*b* that extend into upper sleeve portion 108*a* and lower sleeve portion 108*b* of hinge sleeve 108, respectively. The central portion of door leaf 128 between door leaf extensions 128*a* and 128*b* is received within a slot 110*a* in shroud 110. In the preferred embodiment, door leaf 120 is of a unitary construction, and of suitable strength to support the weight of larger doors.

First hinge member 102 and second hinge member 104 each have a plurality of mounting holes (shown typically in FIGS. 1–3 with reference numerals 102*x* and 104*x*, respectively) within which holes fasteners such as threaded screws (shown typically in FIG. 1 with reference numerals 102*y* and 104*y*, respectively) fit to fasten each respective member to a mounting frame and a door (shown in phantom lines in FIG. 1). When adjustable hinge 100 is installed, first hinge member 102 is mounted within an appropriately-formed recess (not shown) in the mounting frame and second hinge member 104 is mounted within an appropriately-formed recess (not shown) in the corresponding door. (In an alternative embodiment, the mounting arrangement of the first and second hinge members with respect to the mounting frame and door can be reversed.) After adjustable hinge 100 is installed, the door is permitted to pivot about rotational axis 10, which defines the center line of hinge assembly 106, to allow rotational movement of the door relative to the mounting frame, typically between a closed position and a fully open position.

Cover plate 104*a* (shown in FIG. 2) and backing member 104*b*of second hinge member 104 are fastened together by a series of stamped bosses (as shown typically in FIG. 14 with reference numeral 103) in a particularly preferred embodiment suitable for lower-cost manufacturing. Other fastening means known to those of ordinary skill in the art that provide suitable strength can also be employed in the assembly of the second hinge member.

A horizontal adjustment mechanism 130 is contained in a generally orthogonal cavity 132 formed in a central portion of second hinge member 104 between cover plate 104*a* and backing member 104*b*, where a first end 122 of door leaf 120 is received. Horizontal adjustment mechanism 130 includes a horizontal adjustment screw 134 with a threaded end 134*a* and an opposed screw head 134*b* accessible from the direction of cover plate 104*a* through a horizontal adjustment hole 136 (not threaded) in cover plate 104*a*. Door leaf 120 contains at first end 122 a threaded hole 121, which receives threaded end 134*a* of horizontal adjustment screw 134, and a pair of door leaf tabs 126*a* and 126*b* in close proximity to first end 122 (see FIGS. 2 and 4). Backing member 104*b* contains a pair of arcuate slots 138*a* and 138*b* at opposed sides of orthogonal cavity 132 (configured as shown in FIGS. 2, 6–8) which receive each of door leaf tabs 126*a* and 126*b*. Backing member 104*b* also has a ledge 133; cover plate 104*a* has a flange 137 containing a cutout 139. Door leaf 120 extends through a bearing slot (not shown) formed between ledge 133 of backing member 104*b* and cut-out 139 of cover plate 104*a*. Horizontal adjustment mechanism 130 also includes a horizontal adjustment indicator (not shown).

As shown in FIG. 4, horizontal adjustment is effected by rotating threaded horizontal adjustment screw 134 within corresponding threaded hole 121 of door leaf 120, which causes a relative movement of first end 122 of door leaf 120 with respect to second hinge member 104 in an arcuate path defined by arcuate slots 138*a* and 138*b* retaining door leaf tabs 126*a* and 126*b*, respectively, and also by movement of central arch 124 of door leaf 120 between ledge 133 and flange 137 and through the bearing slot, thereby defining a substantially horizontal path of travel of first hinge member 102 relative to second hinge member 104. (Horizontal adjustment screw 134 is threadably connected only with door leaf 120.) As shown by comparison of FIGS. 4, 5 and 7–8, as first end 122 of door leaf 120 travels in its guided path the relative position of first hinge member 102 with respect to second hinge member 104 correspondingly adjusts (as does the angle in which horizontal adjustment screw 134 is retained within horizontal adjustment mechanism 130). Door leaf 120 translates within cavity 132 between backing member 104*b* and cover plate 104*a*, due to the fact that door leaf tabs 126*a* and 126*b* follow arcuate slots 138*a* and 138*b* in backing member 104*b*. Door leaf 120 is retained in and extends through the bearing slot formed between cut-out 139 of cover plate 104*a* and ledge 133 of backing member 104*b* at a distance that varies as translational movement follows arcuate slots 138*a* and 138*b*. The arrangement of the bearing surface created between door leaf 120 and the bearing slot (at or near central arch 124) therefore also varies as door leaf 120 is guided along arcuate slots 138*a* and 138*b*.

In an alternative embodiment, a plurality of horizontal adjustment screws can be employed in a coordinated arrangement to effect horizontal adjustment; similarly the equivalent function of arcuate slots 138*a* and 138*b* shown in the preferred embodiment can be accomplished with alternative arrangements of any type of guide or guide system known in the art, such as a rail (or rails) or routing.

Due to the shape of arcuate slots 138*a* and 138*b* of and door leaf 120 (with central arch 124), horizontal adjustment is substantially confined to a single horizontal direction, whereby hinge assembly 106 travels in a direction substantially perpendicular to the face of second hinge member 104. Adjustment can be effected either way in the horizonal direction (i.e. from one end of the arcuate path to the other). Referring to FIG. 4, it is evident that a relatively substantial range of total horizontal adjustment (shown by letter A) can be effected by operation of horizontal adjustment mechanism 130 (see also FIG. 5). In a particularly preferred embodiment, horizontal adjustment screw 134 can be provided with a protective cap (not shown) such as a mushroomed head at threaded end 134*a* (opposite to screw head 134*b*) in order to prevent horizontal adjustment screw 134 from backing completely out of threaded hole 121 as the limit of adjustment is approached.

Figure 6:
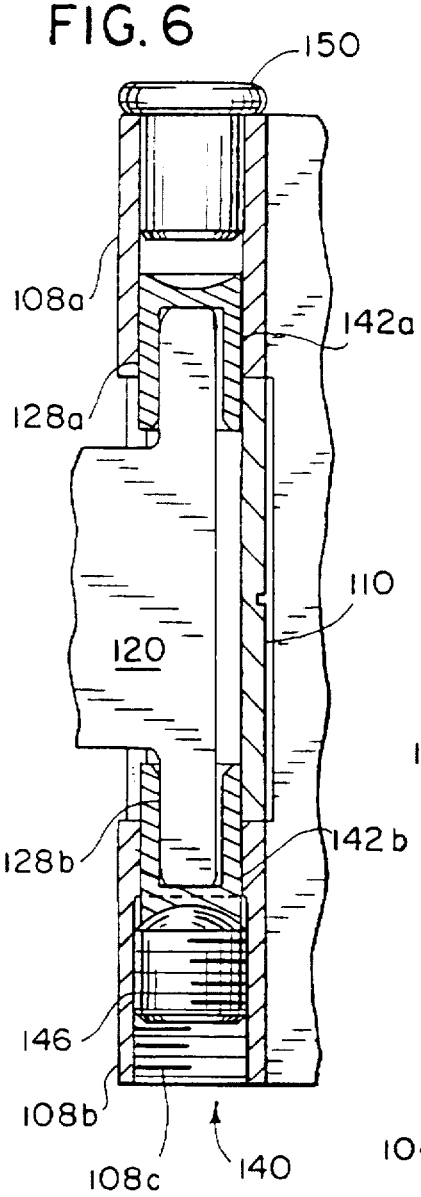
FIG. 6 is a sectional and cut-away view of the two-way adjustable hinge along line 6—6 in FIG. 4 showing the hinge assembly and vertical adjustment mechanism (with the range of vertical adjustment)
Figure 5:
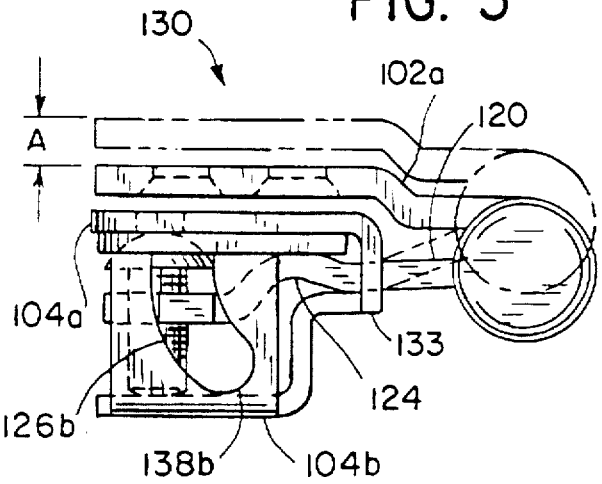
FIG. 5 is a bottom view of the two-way adjustable hinge in a closed position also showing the range of horizontal adjustment.
Figure 7:
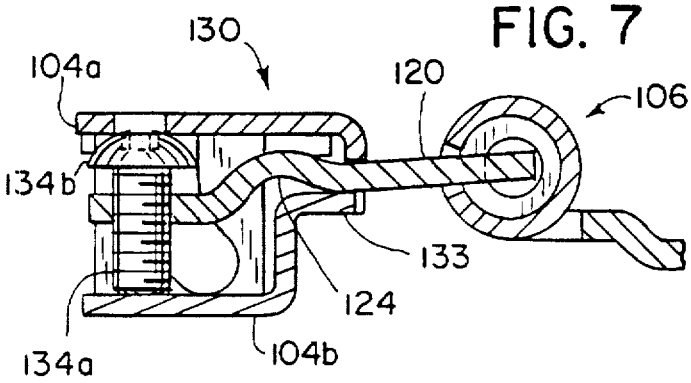
FIG. 7 is a sectional and cut-away bottom view of the two-way adjustable hinge along line 7—7 in FIG. 3 in an opened position showing the horizontal adjustment mechanism in an intermediate position.
Figure 8:
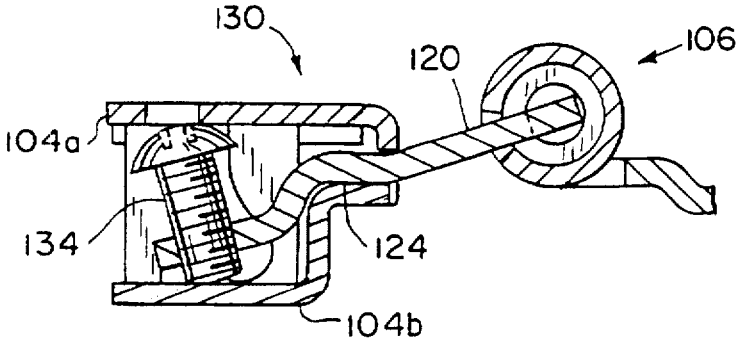
FIG. 8 is a sectional and cut-away bottom view of the two-way adjustable hinge in an opened position showing the horizontal adjustment mechanism in a substantially fully adjusted position.
Figure 9:
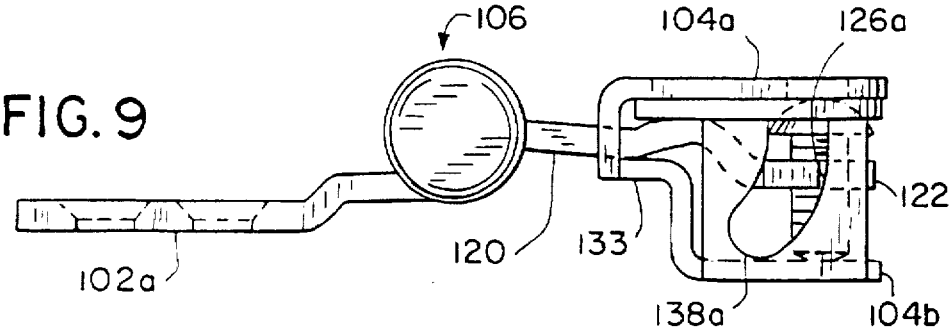
FIG. 9 is a top view of the two-way adjustable hinge in an opened position.

Referring to FIG. 6, hinge assembly 106 is shown in a sectional and cut-away view to reveal a vertical adjustment mechanism 140. Vertical adjustment mechanism 140 includes a pair of bearing cups shown as upper and lower bushings 142*a* and 142*b* which fit within and are free to rotate within the axial bore of hinge sleeve 108 and shroud 110. Referring now back to FIG. 2, bushings 142*a* and 142*b* each have an axial bore (shown typically by a rectangular slot 144*a*) extending within to a suitable depth to receive (rectangular-ended) door leaf extensions 128*a* and 128*b*, respectively. Door leaf 120 is thereby suitably retained by door leaf extensions 128*a* and 128*b* (and their respective bushings 142*a* and 142*b*) within hinge sleeve 108 and shroud 110 to allow pivotal movement of first hinge member 102 with respect to second hinge member 104 about rotational axis 10. Vertical adjustment mechanism 140 also includes a vertical adjustment screw 146 (a set screw or like device) which engages a threaded section 108*c* within the axial bore at lower sleeve portion 108*b* of hinge sleeve 108 (i.e., opposite hinge cap 150) along rotational axis 10.

As is evident in FIG. 6, vertical adjustment is effected by turning vertical adjustment screw 146, which engages threaded section 108*c* and which effects a relative vertical movement (upward or downward) of lower bushing 142*b* with respect to first hinge member 102 and therefore linear movement of door leaf 120 in a substantially vertical direction along rotational axis 10 within hinge sleeve 108 and shroud 110. Vertical adjustment (shown in FIG. 3 by the letter B) can be effected in either vertical direction within a range defined by the particular design of vertical adjustment mechanism 140. Downward vertical adjustment of door leaf 120 is assisted by the weight of the door; upward vertical adjustment must overcome the weight of the door. By virtue of the fit and configuration of bushings 142*a* and 142*b* within hinge sleeve 108 and shroud 110 and of door leaf extensions 128*a* and 128*b* within bushings 142*a* and 142*b*, twisting or "play" of door leaf 120 within hinge assembly 106 is minimized.

Referring to FIG. 3, when adjustable hinge 100 is installed, the weight of the door (not shown) is carried by door leaf 120 extending from second hinge member 104; lower door leaf extension 128*b* forces lower bushing 142*b* downward. During pivotal movement of the door relative to the mounting frame (i.e. opening and closing), a bearing area is therefore created at the mating surfaces of the upper end of vertical adjustment screw 146 and the lower end of lower bushing 142*b*. As will be apparent to those of ordinary skill in the art, the configuration of lower bushing 142*b* can be adjusted within available space limits to adjust the size of the bearing area (and to adjust the corresponding bearing forces).

Bushings 142*a* and 142*b* can be made of plastic or metal. However in a particularly preferred embodiment, they are made of a plastic ("DELRIN 500" or the like) to provide for quiet, smooth and maintenance-free operation, eliminating the need for lubrication of internal mating parts that bear on one another during use of the door. In any preferred embodiment, bushings 142*a* and 142*b* are made of a material that is suitably wear-resistant and permits the relatively smooth and quiet opening and closing of the door. As seen in FIG. 2, lower bushing 142*b* has a pair of alignment slots 144*b* and 144*c* that facilitate assembly by indicating the rotational orientation of rectangular axial slot 144*a*within lower sleeve portion 108*b* of sleeve 108 to facilitate insertion of upper and lower door leaf extensions 128*a* and 128*b* during assembly.

Referring back to FIG. 2, in a particularly preferred embodiment, door leaf 120 is formed from a single piece of material including door leaf extensions 128*a* and 128*b*, central arch 124, door leaf tabs 126*a* and 126*b* and threaded hole 121. In the preferred embodiment, door leaf 120, jamb leaf 102*a*, shroud 110, cover plate 104*a* and backing member 104*b* are formed of corrosion-resistant materials or provided with a corrosion-resistant finish. (Exemplary two-way adjustable hinges generally known in the art are zinc die-cast; when brass plating is required the cover is brush-finished apparently to hide defects in the casting.) Since cover plate 104*b* according to the preferred embodiment of the present invention can be cold-rolled steel, it can be given a bright, brass finish. Hinge cap 150 on top of the upper sleeve portion 108*a* of hinge sleeve 108 could also be provided with a matching finish. In a particularly preferred embodiment, first and second hinge members 102 and 104 (i.e. the construent components), as well as unitary door leaf 120, are formed in brass in a stamping operation.

Figure 10:
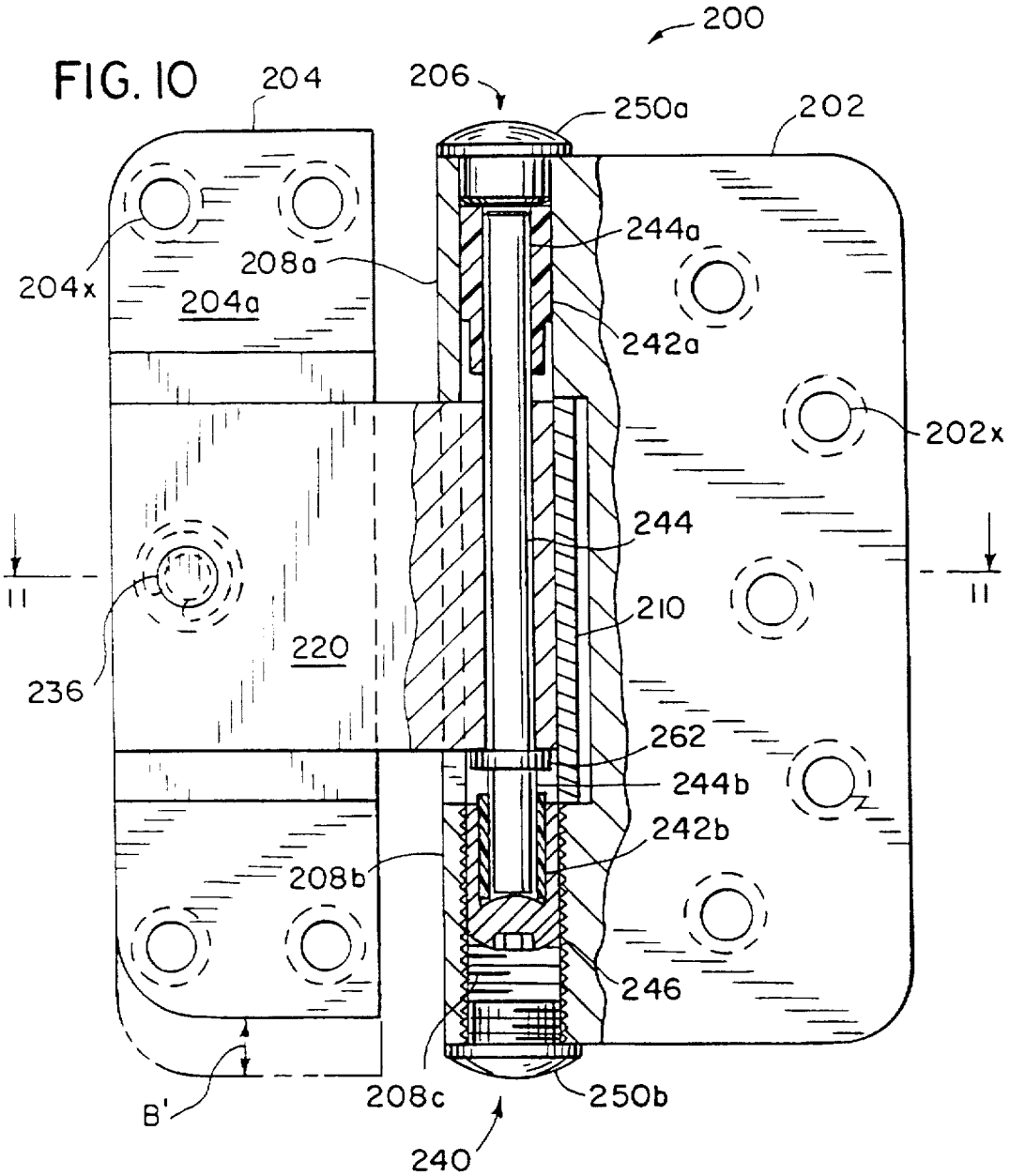
FIG. 10 is a front view of a two-way adjustable hinge according to an alternative embodiment of the present invention in an opened position also showing a cut-away view of the hinge assembly and vertical adjustment mechanism (with the range of vertical adjustment)

An alternative embodiment of a two-way adjustable hinge 200 according to the present invention is shown in FIGS. 10 through 13. Referring now to FIG. 10, adjustable hinge 200 comprises a first hinge member 202 (shown by jamb leaf 202*a*) and a second hinge member 204 (shown by a cover plate 204*a*) pivotally coupled within a hinge assembly 206 by a door leaf 220. Hinge assembly 206 includes a top hinge cap 250*a* and a bottom hinge cap 250*b*. First hinge member 202 and second hinge member 204 each have a plurality of mounting holes (shown typically in FIG. 10 with reference numerals 202*x* and 204*x*, respectively) within which holes fasteners such as threaded screws (not shown) fit to fasten each respective member to a mounting frame and a door (as for the preferred embodiment).

Figure 11:
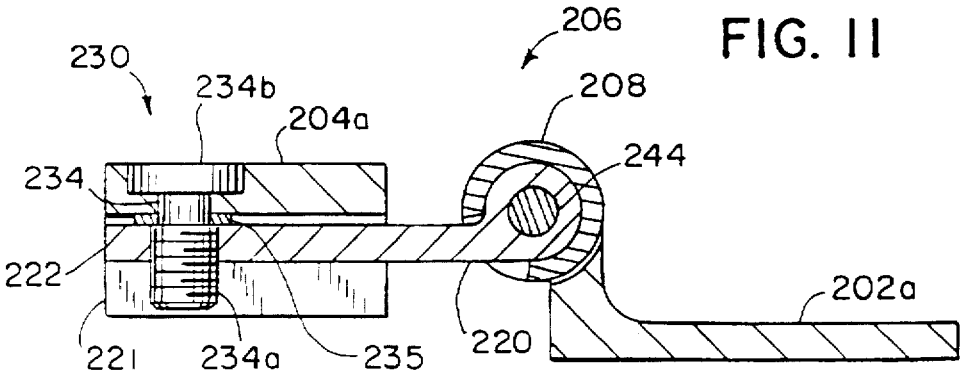
FIG. 11 is a bottom view of an alternative embodiment of the two-way adjustable hinge along line 11—11 in FIG. 10 in an opened position.

According to this embodiment, a horizontal adjustment mechanism 230 includes a generally orthogonal recess 232 within cover plate 204*a* (see FIG. 13) to receive a correspondingly-shaped first end 222 of substantially flat door leaf 220 (see FIGS. 11 and 12). Horizontal adjustment mechanism 230 also includes a horizontal adjustment screw 234 with a threaded end 234*a* and an opposed screw head 234*b* received within cover plate 204*a* through a horizontal adjustment hole 236, which is partially threaded and also countersunk to receive screw head 234*b* (see FIG. 13). Door leaf 220 also contains a threaded hole 221, which receives horizontal adjustment screw 234 coupling door leaf 220 to cover plate 204*a*. (In an alternative embodiment a plurality of horizontal adjustment screws can be employed in a coordinated arrangement.) A washer or the like shown as retaining clip 235 is seated on horizontal adjustment screw 234 between cover plate 204*a* and door leaf 220. In an alternative embodiment, horizontal adjustment screw 234 can be provided with a cap (not shown) at an end opposite to screw head 234*a* in order to prevent horizontal adjustment screw 234 from backing out of threaded hole 221 as the limit of adjustment is approached. Horizontal adjustment mechanism 230 also includes a horizontal adjustment indicator (not shown).

As shown in FIG. 10, horizontal adjustment is effected by turning horizontal adjustment screw 234, which causes a relative movement of first end 222 of door leaf 220 in a substantially horizontal direction of travel axial to threaded hole 221 and horizontal adjustment screw 234, along the edges 232*a* and 232*b* of recess 232 which retain and guide edges 222*a* and 222*b* of door leaf 220. The linear path of travel of door leaf 220 follows the axis of horizontal adjustment screw 234. As shown in FIGS. 11 and 12, as first end 222 of door leaf 220 travels in the linear path defined by edges 232*a* and 232*b* of recess 232, the position of door leaf 220 relative to jamb leaf 202*a* (i.e., of first hinge member 202 relative to second hinge member 204) is adjusted in a horizontal direction. Referring to FIG. 12, it is evident that a relatively significant range of total horizontal adjustment (shown by letter A') can be effected in either direction of operation of horizontal adjustment mechanism 230.

Referring to FIG. 10, hinge assembly 206 is shown in a cut-away view to reveal a vertical adjustment mechanism 240. Vertical adjustment mechanism 240 includes a pair of bearing sleeves shown as upper and lower bushings 242*a* and 242*b*, which fit within the axial bore of hinge sleeve 208 and shroud 210. Bushings 242*a* and 242*b* each have an axial bore (not shown) to receive a pivot pin 244. Pivot pin 244 is also received in a sleeve (not shown) formed by a throughgoing axial bore in door leaf 220. Pivot pin 244 fully extends through the sleeve formed in door leaf 220 to expose upper and lower pivot pin extensions 244*a* and 244*b*, retained in bushings 242*a* and 242*b*, respectively, which are in turn received within hinge sleeve 208 and shroud 210 to allow pivotal movement about a rotational axis 20 of hinge assembly 206. (Door leaf 220 is free to rotate about pivot pin 244.) Pivotal movement of door leaf 220 about rotational axis 20 corresponds to pivotal movement of first hinge member 202 relative to second hinge member 204.

Vertical adjustment mechanism 240 also includes a vertical adjustment screw 246 (a set screw or like device) which engages a threaded section 208*c* of hinge sleeve 208 below lower extension 244*b* of pivot pin 244. The bottom surface of lower extension 244*b* of pivot pin 244 bears upon the top surface of vertical adjustment screw 246. A flat rim 262 formed in pivot pin 244 as part of lower extension 244*b* creates a horizontal bearing surface with door leaf 220 by which door leaf 220 is supported and therefore can be raised or lowered. Referring to FIG. 10, when adjustable hinge 200 is installed, the weight of the door (not shown) is carried by door leaf 220 which forces rim 262 of pivot pin 244 downward and therefore forces the bottom surface of pivot pin 244 downward into vertical adjustment screw 246.

As is evident in FIG. 10, vertical adjustment is effected by turning vertical adjustment screw 246, which engages threaded section 208*c* of the lower portion of hinge sleeve 208, thereby effecting a coordinated relative vertical movement (upward or downward) of rim 262 and therefore linear movement of door leaf 220 in a substantially vertical direction along rotational axis 20 within hinge sleeve 208 and shroud 210. (Downward vertical adjustment is assisted by the weight of the door; upward vertical adjustment must overcome the weight of the door.) Vertical adjustment can be effected in either direction within a range (shown by B') defined by the particular design of vertical adjustment mechanism 240.

Bottom hinge cap 250*b* inserted within lower portion 208*b* of sleeve 208 may improve aesthetic appearance; it may also limit the downward movement of the vertical adjustment screw 246. Without bottom hinge cap 250*b*, it may be possible for vertical adjustment screw 246 to be backed out (due to bearing forces transmitted from pivot pin 244) to the point where the upper extension 244*a* is no longer inside the upper sleeve portion 208*a* of sleeve 208. This condition can be prevented by using a stop (not shown) within sleeve 208. However, the stop could cause squeaking and also would require door leaf 220 to be "two-handed" (i.e. configured differently depending on the side of the mounting frame on which it is mounted). The hinge according to a preferred embodiment could also develop a squeaking noise if the door is lowered too far below the position. When lowered too far, door leaf 220 may scrape over the upper edge of lower sleeve portion 208*b* of sleeve 208 (instead of on rim 262 of pivot pin 244 if rim 262 is lowered below the upper edge of lower sleeve portion 208*b*). In any particularly preferred embodiment of the adjustable hinge, the likelihood of these potential difficulties can be minimized by monitoring the position of the door with respect to the upper frame or lower frame (or by using the vertical adjustment indicator). The fit of the vertical adjustment screw 246 within threaded lower portion 208*b* of sleeve 208 can be adjusted to prevent movement beyond a desirable range.

The alternative embodiment is also suitable for manufacture by lower-cost methods, as described for the preferred embodiment; any material of sufficient strength (as would be known to one of ordinary skill in the art), including premium materials such as brass, can be used for any embodiment.

In any preferred embodiment, the first hinge member (i.e., jamb leaf) fits the existing jamb routing of conventional mounting frames. Conversely, some generally known adjustable hinges require a two-step routing into the edge of the door (i.e., the first routing is sized to fit the visible hinge cover; the second routing clears the hidden parts within the base member). In a conventional arrangement of the preferred or alternative embodiment, it is necessary for a routing of the door (for the second hinge member); the routing is set back no less than 0.1875 inch from the face of the door. The exposed edge of the backing member is recessed (approximately 0.040 inch in a particularly preferred embodiment) from the face of the door for purposes of concealing the appearance of this edge, which in some alternative embodiments is not brass-plated. Recessing the edge makes the edge less noticeable.

The adjustable hinge according to the preferred embodiment is assembled in a "right-handed" and a "left-handed" arrangement depending upon the orientation necessary for the intended installation. After assembly and mounting of the door in a conventional arrangement of the preferred or alternative embodiment, the installer upwardly adjusts the vertical position of (i.e., raises) the door relative to the mounting frame by turning the vertical adjustment screw of one hinge (probably the center hinge) of the hinges used (three are typically used) to install the door. After the door is at the correct height the installer then turns the vertical adjustment screws of the other two hinges, stopping when they no longer turn freely (otherwise the door would be raised too far). Properly adjusted, each vertical adjustment screw fits snugly against its bearing surface so that the door weight is carried by all (i.e. all three) hinges instead of only one hinge. Similarly, if the door needs to be lowered, the installer would first back out the vertical adjustment screws of the top and bottom hinges causing the door to bear on the center hinge only. After lowering the door with the vertical adjustment screw of the center hinge, the installer would then snug up the vertical adjustment screws of the other (two) hinges. (In a particularly preferred embodiment, the installer is able to "feel" the snug fit of each vertical adjustment screw because the screws are not otherwise designed to turn tightly, as could happen if a nylon insert or patch is used within the vertical adjustment mechanism.)

It may sometimes be necessary to remove a door from the mounting frame (i.e. from its hinges). In conventional hinges, this is commonly done by "knocking out" (i.e. removing completely) the hinge pin. Some generally known adjustable hinges have removable hinge pins which also can readily be knocked out, although it may be that internal elements may be disassembled and lost. The hinge according to the preferred (and alternative) embodiment does not have a removeable hinge pin and therefore cannot be disassembled in the manner of a conventional hinge. The door can only be removed by unscrewing the first hinge member or second hinge member (both secured with a plurality of screws) from the door or mounting frame. (This arrangement provides added security in the preferred embodiment.) According to another alternative embodiment of the present invention (not shown), the removal of the door from the hinges (without having to unscrew all fasteners) could be more easily accommodated by fastening an additional mounting plate to the mounting frame, with the first hinge member mounted to the plate with a screw (or like fastener). The installer would then remove or loosen this (single)

screw when the door needs to be removed (with the hinges attached to the door). The screw might also be configured to allow positional adjustments.

In a particularly preferred embodiment, each of the vertical and horizontal adjustment screws have an Allen (or hex) head to reduce the likelihood of stripping the screw head during adjustment; nevertheless, any other fasteners of like effect known to those of ordinary skill in the art can also be used.

While the present invention has been described in connection with the preferred embodiments, the invention may be variously embodied. For example, the adjustable hinge can be configured to include only the vertical adjustment mechanism or only the horizontal adjustment mechanism; the mounting arrangement of the first hinge member and second hinge member can also be reversed. Accordingly, the scope of the invention is to be limited solely by the scope of the claims which follow. Those skilled in the art will readily appreciate that many modifications are possible in the exemplary embodiments without materially departing from the novel teachings and advantages of this invention. All such modifications are intended to be included within the scope of the invention as defined in the following claims. In the claims, each means-plus-function clause is intended to cover the structures described herein as performing the recited function and not only structural equivalents but also equivalent structures.

What is claimed is:

1. An adjustable hinge comprising:

a first hinge member having a hinge sleeve with an upper portion and a lower portion;

a second hinge member having a guide;

a door leaf having a first end and a second end, the first end being coupled to the second hinge member and having at least one tab received within the guide of the second hinge member for guiding movement therealong, and the second end coupled to the first hinge member, the second end having an upper extension and a lower extension, the upper extension received within the upper portion of the hinge sleeve and the lower extension received within the lower portion of the hinge sleeve, selectively allowing pivotal movement of the first hinge member relative to the second hinge member about a rotational axis extending in a vertical direction;

a vertical adjustment screw threadably received within the lower portion of the hinge sleeve below the lower extension of the door leaf for movement within the hinge sleeve, selectively allowing movement of the first hinge member relative to the second hinge member in the vertical direction; and a horizontal adjustment screw threadably received within a threaded hole in the first end of the door leaf, the first end of door leaf being retained by the horizontal adjustment screw within a cavity formed within the second hinge member, whereby rotation of the horizontal adjustment screw moves at least one tab along the guide, selectively allowing movement of the first hinge member relative to the second hinge member in a horizontal direction.

2. The adjustable hinge of claim 1 wherein the second hinge member includes a cover plate and a backing member, and with the guide disposed within the backing member and the cavity disposed between the cover plate and the backing member.

3. The adjustable hinge of claim 1 further comprising at least one hinge cap received within the hinge sleeve.

4. The adjustable hinge of claim 1 wherein the horizontal adjustment screw has a cap to prevent it from backing out of the threaded hole.

5. The adjustable hinge of claim 1 wherein the guide is arcuate in shape.

6. The adjustable hinge of claim 1 wherein the upper door leaf extension is received within an upper bushing and the lower door leaf extension is received within a lower bushing, the upper bushing being received within the upper portion of the hinge sleeve and the lower bushing being received within the lower portion of the hinge sleeve.

7. The adjustable hinge of claim 6 wherein at least one of the upper bushing and lower bushing is made of a plastic material that does not require lubrication.

8. The adjustable hinge of claim 6 wherein at least one of the lower bushing includes a recess in which the lower door leaf extension is received and means for indicating the rotational orientation of the lower bushing within the lower portion of the hinge sleeve.

9. The adjustable hinge of claim 1 wherein the first hinge member is mounted to a door and the second hinge member is mounted to a mounting frame for the door.

10. An adjustable hinge comprising:

a first hinge member having a hinge sleeve with an upper portion and a lower portion;

a second hinge member having a guide;

a door leaf having a first end and a second end, the first end being coupled to the second hinge member and having at least one tab received within the guide of the second hinge member for guiding movement therealong, and the second end coupled to the first hinge member, the second end having an upper extension and a lower extension, the upper extension received within the upper portion of the hinge sleeve and the lower extension received within the lower portion of the hinge sleeve, selectively allowing pivotal movement of the first hinge member relative to the second hinge member about a rotational axis extending in a vertical direction; and a horizontal adjustment screw threadably received within a threaded hole in the first end of the door leaf, the first end of door leaf being retained by the horizontal adjustment screw within the guide of the second hinge member, whereby rotation of the horizontal adjustment screw moves at least one tab along the guide, selectively allowing movement of the first hinge member relative to the second hinge member in a horizontal direction.

11. An adjustable hinge comprising:

a first hinge member having a hinge sleeve with an upper portion and a lower portion;

a second hinge member;

a door leaf having a first end and a second end, the first end being coupled to the second hinge member and the second end coupled to the first hinge member, the second end having an upper extension and a lower extension, the upper extension received within the upper portion of the hinge sleeve and the lower extension received within the lower portion of the hinge sleeve, selectively allowing pivotal movement of the first hinge member relative to the second hinge member about a rotational axis extending in a vertical direction; and a vertical adjustment screw threadably received within the lower portion of the hinge sleeve below the lower extension of the door leaf for movement within the hinge sleeve, selectively allowing movement of the first hinge member relative to the second hinge member in the vertical direction.

12. An adjustable hinge comprising:

a first hinge member having a hinge sleeve with an upper portion and a lower portion;

a second hinge member having a cover plate and a backing member, the backing member having a guide;

a door leaf having a first end and a second end, the first end being coupled to the second hinge member and having at least one tab received within the guide of the backing member for guiding movement therealong, and the second end coupled to the first hinge member, the second end having an upper extension and a lower extension, the upper extension received within the upper portion of the hinge sleeve and the lower extension received within the lower portion of the hinge sleeve, selectively allowing pivotal movement of the first hinge member relative to the second hinge member about a rotational axis extending in a vertical direction; and a vertical adjustment screw threadably received within the lower portion of the hinge sleeve below the lower extension of the door leaf for movement within the hinge sleeve, selectively allowing movement of the first hinge member relative to the second hinge member in the vertical direction; and a horizontal adjustment screw threadably received within a threaded hole in the first end of the door leaf, the first end of door leaf being retained by the horizontal adjustment screw within the guide of the second hinge member, whereby rotation of the horizontal adjustment screw moves the at least one tab along the guide, selectively allowing movement of the first hinge member relative to the second hinge member in a horizontal direction.

13. The adjustable hinge of claim 12 wherein the guide is arcuate in shape.

14. The adjustable hinge of claim 12 wherein the upper door leaf extension is disposed within an upper bushing and the lower door leaf extension is disposed within a lower bushing, the upper bushing being received within the upper portion of the hinge sleeve and the lower bushing being received within the lower portion of the hinge sleeve.

15. The adjustable hinge of claim 14 wherein at least one of the upper bushing and lower bushing is made of a plastic material that does not require lubrication.

16. The adjustable hinge of claim 14 wherein the lower bushing includes a recess in which the lower door leaf extension is received and means for indicating the rotational orientation of the lower bushing within the lower portion of the hinge sleeve.

* * * * *